United States Patent [19]

Fujiwara

[11] Patent Number: 4,930,916

[45] Date of Patent: Jun. 5, 1990

[54] PAPER FEEDER

[75] Inventor: Shinsuke Fujiwara, Osaka, Japan

[73] Assignee: NEC Home Electronics Ltd., Osaka, Japan

[21] Appl. No.: 277,866

[22] Filed: Nov. 30, 1988

[30] Foreign Application Priority Data

Nov. 30, 1987 [JP] Japan ..... 62-302917

[51] Int. Cl.[5] ..... B41J 13/02

[52] U.S. Cl. ..... 400/636; 400/636.2

[58] Field of Search ..... 400/636, 636.2, 567, 400/569, 556.2

[56] References Cited

U.S. PATENT DOCUMENTS

| | | | |
|---|---|---|---|
| 4,090,410 | 5/1978 | Nakamura | 400/636 X |
| 4,217,057 | 8/1980 | Nakamura | 400/636 |
| 4,346,883 | 8/1982 | Speraggi | 400/636 X |
| 4,439,051 | 3/1984 | Lawter | 400/636 X |
| 4,710,046 | 12/1987 | Ookubo | 400/556.2 |

FOREIGN PATENT DOCUMENTS

| | | | |
|---|---|---|---|
| 166085 | 10/1983 | Japan | 400/636.2 |
| 183278 | 10/1983 | Japan | 400/636.2 |
| 32777 | 2/1986 | Japan | 400/636.2 |
| 189967 | 8/1986 | Japan | 400/636.2 |

*Primary Examiner*—Edgar S. Burr
*Assistant Examiner*—Joseph R. Keating
*Attorney, Agent, or Firm*—Cushman, Darby & Cushman

[57] ABSTRACT

A paper feeder roller wherein a motor transfers a driving force to a deceleration gear train. The deceleration gear train transfers this force to the shaft of a paper feeder roller which is rotated thereto. A plate connected to the paper feeder roller is rotatable about an axis so that the rotation of the plate rotates the paper feeder roller in and out of engagement with the deceleration gear train. When the paper feeder roller is disengaged with the deceleration gear train, the paper feeder roller can be rotated manually.

5 Claims, 3 Drawing Sheets

PAPER FEEDER

BACKGROUND OF THE INVENTION

The present invention relates to a paper feeding roller for use with a printer, and more particularly, to a rotation propagating system, based on manual operation, for rotationally driving a paper feeding roller.

A printer is typically equipped with a paper feeding mechanism for feeding sheets of paper in a column-direction orthogonal to a printing-row-direction along a front surface of a platen. This paper feeding mechanism is typically composed of a paper feeding roller disposed in the middle of a paper feeding passageway leading from a paper insertion port of a casing via a front surface of the platen to a discharge port, a friction roller so supported on the paper feeding roller as to be press-fittable thereto and releasable therefrom, and a driving system for rotationally driving the paper feeding roller. This driving system incorporates a deceleration gear mechanism for feeding the paper by transferring a driving force of a motor to rotate the paper feeding roller, or alternatively by manually rotating the paper feeding roller.

According to the prior art, this type of paper feeding mechanism has a construction illustrated, e.g., in FIG. 5. The casing 1 of the printer body encases a base frame 2 mounted with a printing mechanism unit constituting the printer and a paper feeding unit. The frame 2 includes a pair of side frames 2*a* and 2*b* which stand erect bilaterally and are parallely disposed at a given spacing. A platen (not illustrated) is supported between the side frames 2*a* and 2*b*. The printing mechanism unit (not shown) is placed in front of the platen, while the paper feeding mechanism unit is disposed in back of the platen.

A paper feeding roller 3 is rotatably supported between the side frames 2*a* and 2*b*. A friction roller 4 is supported in one radial direction of the paper feeding roller 3 so that the friction roller 4 is freely rotatable and movable in the radial direction. The friction roller 4 is press-fitted to the paper feeding roller 3 by the biasing force of a spring.

The side frame 2*a* is fitted with a stepper motor 5 intended to feed the paper. A small diameter gear 6 of a first stage is mounted on the driving shaft of the stepper motor 5. A large diameter gear 6*b* of a second stage and a small diameter gear 6*c* of a third stage are rotatably coaxially mounted on the side frame 2*a*. The first stage gear 6*a* meshes with the large diameter gear 6*b*. The large diameter gear 6*b* meshes with the small diameter gear 6*c*. The paper feeding roller 2 is equipped with a large diameter gear 6*d* of a final stage. The final stage gear 6*d* engages the third stage gear 6*c*. A gear train is formed of the gears 6*a* through 6*d*. A deceleration gear system 6 having a specified deceleration ration is thus constructed.

The paper feeding roller 3 is rotated through the deceleration gear system 6 by the driving force of the stepper motor 5. The rotation of this paper feeding roller 3 permits the feeding of the paper sandwiched in between the paper feeding roller 3 and the friction roller 4 along a predetermined paper feeding passageway. The paper passing between the paper feeding roller 3 and the friction roller 4 is fed via the front surface of the platen to a paper discharge port provided at an upper portion of the printer body while being guided by a paper guide (not shown). The driving shaft of the stepping motor 5 is extended in the axial direction, and its axial end is protruded on one side of the printer body 1. The axial end of the driving shaft is provided with a knob 7.

The knob 7 is manually turned outside the printer body 1, thereby rotating the driving shaft of the stepper motor 5. Consequently, the paper feeding roller 3 can be rotated through the deceleration gear system.

FIG. 6 depicts another type of conventional paper feeding system. A support shaft 8 is rotatably supported on one side portion of the stepper motor 5 in parallel with the driving shaft. One end of this support shaft 8 projects outside the printer 1, and the protruding end thereof is fitted with, a knob 7. The driving shaft of the stepper motor 5 is extends backwards. The rear end of this driving shaft and the other end of the support shaft 8 are provided with pulleys 9*a* and 9*b*, respectively. A belt 9*c* is stretched between the pulleys 9*a* and 9*b*. Based on this construction, the rotational force generated by manually operating the knob 7 is transferred via the belt/pulley mechanism 9 indirectly to the driving shaft.

As described above, in the conventional paper feeding mechanism the manual paper feeding operation involves the steps of rotating the knob 7, conveying the rotational force through the driving shaft of the stepper motor 5 to the deceleration gear system 6 and further rotating the paper feeding roller 3. By virtue of this manual paper feeding, there are effected positional adjustment to paper fed in and out of the printer.

The above-mentioned conventional paper feeding mechanism has, several defects. In both of the systems illustrated in FIGS. 5 and 6, the arrangement is such that the driving shaft of the stepper motor 5 is rotated by rotating the knob 7, and the rotational force is conveyed via the deceleration gear system 6 to the paper feeding roller 3. Hence, in the case of manually feeding the paper, if a deceleration ratio of the deceleration gear system 6 is set such as $N=1/20$, one rotation of the paper feeding roller 3 requires at least 20 rotations of the knob 7. The amount of paper fed is thus reduced, as compared with a frequency of rotation of the manual feeding knob 7. A large number of rotations of the knob 7 are needed for providing a required amount of paper feed.

In accordance with the prior art manual paper feeding system, in both cases shown in FIG. 5 and 6, the rotation of the knob 7 is transferred from the driving shaft of the motor 5 via the deceleration gear system 6 to the paper feeding roller 3. Therefore, where the deceleration ratio of the deceleration gear system 6 is large, it follows that a large force must be applied when the knob 7 is rotated. For this reason, the rotation can not easily be made by manual operation. As a result, it is quite difficult to perform the manual paper feeding because a large number of rotations must be done.

Besides, in the conventional paper feeding system, the rotational force is conveyed from the driving shaft of the stepper motor 5 via the deceleration gear system 6 to the paper feeding roller 3, at which time considerable deceleration is caused. Hence, the shaft must be extended long, and its end is fitted with the knob, or other special contrivances in order to cause rotations of the paper feeding roller 3 with no obstacle. For this reason, inexpensive motors available in the market can not to be used and particular specifications are required. This leads to greater cost than if commercially available ready-made motors could be utilized.

SUMMARY OF THE INVENTION

Accordingly, it is an object of the present invention to provide a paper feeder capable of easily manually feeding a large number of sheets of paper fast without requiring excessive force.

These and other objects are achieved by a paper feeder in which a driving force is transferred from a driving shaft of a driving motor for paper feeding via a deceleration gear train to a shaft of a paper feeding roller, thus rotating the paper feeding roller, the improved paper feeder according to the present invention is constructed such that: a plate is supported on the paper feeding roller shaft so as to be freely rotatable about an axis thereof; a gear train meshing with a final stage gear attached to the paper feeding roller shaft is mounted on the plate; the rotation of the plate permits engagement or disengagement of the gear of the deceleration gear train on the side of the driving shaft with or from the gear on the side of the paper feeding roller shaft; and the paper feeding roller shaft can manually be rotated in response to the rotation of a knob through the final stage gear in a state where the deceleration gear train is released from the gear of the driving shaft.

Upon rotation of the plate in one direction, the gear on the side of the driving shaft meshes with the gear on the side of paper feeding roller, thus forming the deceleration gear train leading from the driving shaft of the motor to the paper feeding roller shaft. When driving the motor in this state, its driving force is propagated via the deceleration gear train to the paper feeding roller shaft, thereby rotating the paper feeding roller. Based on these steps, the paper is fed by driving the motor.

Upon rotation of the plate in the other direction, the gear on the side of driving shaft is released from the gear on the side of the paper feeding roller shaft including the knob. In this state, the knob is rotated, at which time the paper feeding roller shaft is rotated immediately after being separated from the driving shaft of the motor. When rotating the knob, the rotational force is conveyed via the final stage gear attached directly or indirectly to the paper feeding roller shaft in a moderate rotational motion at a rotational ratio of approximately 1 : 1.5 or 1 : 1, or at the minimum rotational ratio.

Hence, the paper feeding roller is rotated with a rotational quantity substantially proportional to the amount of rotation of the knob, and a sufficient amount of paper can be fed.

DETAILED DESCRIPTION OF THE PREFERRED EMBODIMENT:

An embodiment of the present invention will hereinafter be described with reference to the accompanying drawings wherein like references represent like parts throughout.

Figure 1:
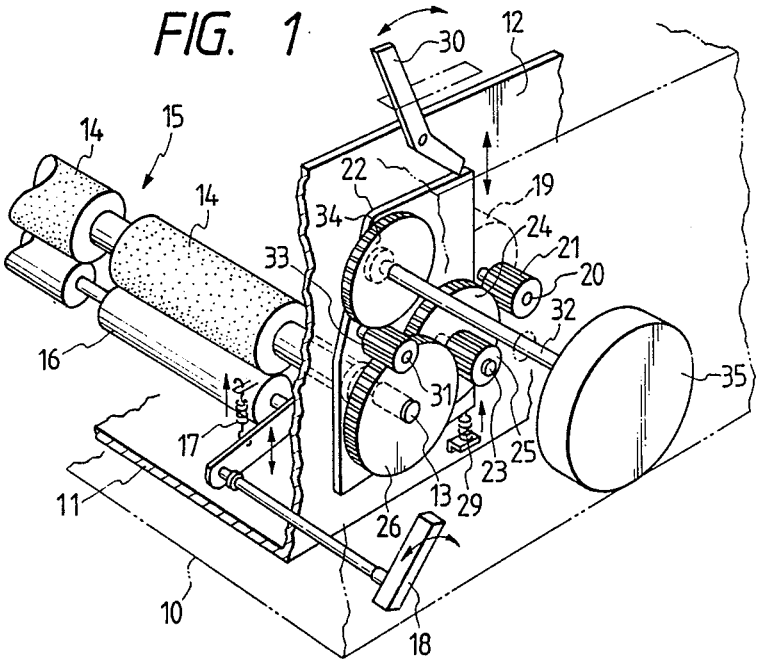
FIG. 1 is a perspective view illustrating the paper feeder of the printer according to the present invention.
Figure 2:
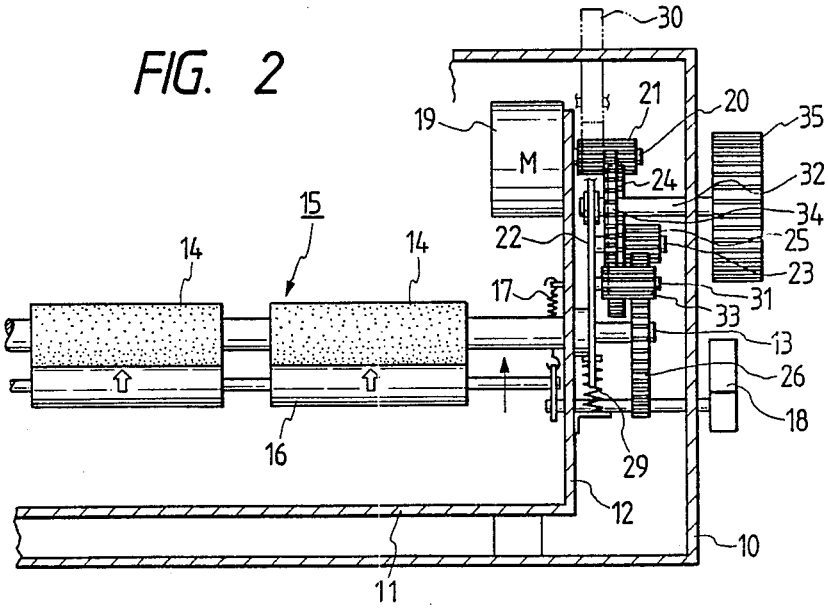
FIG. 2 is a front elevation of the paper feeder of the printer according to the present invention.

Turning attention to FIGS. 1 and 2, there is illustrated a paper feeder according to the present invention. A casing of a printer body encases a frame 11 equipped with a printing mechanism unit (not shown) constituting a printing and a paper feeding mechanism unit. A platen is, though not illustrated, parallely supported on the frame 11 as to stand vis-a-vis with a printing head of the printing mechanism unit; and at the backward lower portion thereof the paper feeding mechanism unit is placed. This paper feeding mechanism unit is disposed in the middle of a paper feeding passageway leading from a paper insertion port formed in the rear portion of the casing 10 to a discharge port formed in the upper portion. The paper is inserted from the paper insertion port formed in a rear portion and passes by the front surface of the platen and is then discharged from the discharge port to the front upper portion.

The frame 11 includes a pair of side frames 12 parallely disposed at a given spacing as to stand erect on both sides. Rotatably supported between the two side frames 12 is a paper feeding roller shaft 13 fitted with roller members 14 each formed of a material such as rubber having a high frictional coefficient. The roller shaft 13 and the roller members 14 are combined to form a paper feeding roller 15. Disposed beneath the paper feeding roller 15 between the side frames 12 is a friction roller 16 which is so supported as to be freely rotatable about an axis and approachable and separable in the radial direction of the paper feeding roller 15.

The friction roller 16 is biased by a spring 17 in the radially central direction of the paper feeding roller 15 and is press-fitted to the paper feeding roller 15 under a predetermined pressure. The friction roller 16 is linked to a lever 18 mounted on the outer portion of the casing 10, whereby the friction roller 16 moves in the radial direction of the paper feeding roller 15 in response to the rotation of the lever 18 and is separated therefrom resisting the the spring 17 or is press-fitted thereto while being biased by the spring 17. Owing to the press-fit and separation of the friction roller 16, the paper is inserted between the roller 15 and 16 by the separation during insertion of the rollers 15 and 16. When feeding the paper, the paper is sandwiched between the rollers 15 and 16 and frictionally fed therethrough in the paper feeding direction.

A stepper motor 19 is mounted on one of the two side frames 12. The stepper motor 19 is secured to the inner surface of side frame 12, and a driving shaft thereof juts out from the side frame 12. The driving shaft 20 is formed with a small diameter gear 21 of a first stage. One end of the paper feeding roller shaft 13 is protruded outside one side frame 12. Outside one side frame 12 a plate 22 is so supported on the protruding end of the paper feeding roller shaft 13 as to be freely rotatable about the shaft 13. A support shaft 23 stands erect between the driving shaft 20 abutting the plate 22 and the paper feeding roller shaft 13. A large diameter gear 24 of a second stage and a small diameter gear 25 of a third stage are coaxially rotatably supported on the support shaft 23. An axial end of the paper feeding roller shaft 13 is provided with a large diameter gear 26 of a final stage which meshes with the third stage gear 25. The second stage gear 24 engages with the first stage gear 21 mounted on the driving shaft 20 when plate 22 is rotated in one direction. If the plate 22 is rotated in the reverse direction, the first stage gear 21 on the side of the driving shaft 20 is released from the second stage gear 24.

A compression spring 29 is provided between the plate 22 and the inner surface side portion of the frame 11. The plate 22 undergoes a unidirectional bias given by the stretching force of the compression spring 29 in the rotating direction. More specifically, the plate 22 is biased by the biasing force of the compression spring 29 such that the second stage gear 24 meshes with the first stage gear 21. The two pieces of gears 21 and 24 are thus engaged with each other.

A lever member 30 is rotatably supported above the plate 22 on the opposite side to the compression spring 29. One end of the lever member 30 impinges upon the upper end of the plate 22, and the other end thereof protrudes upward outside the casing 10. The plate 22 is rotated by a unidirectional level operation of the lever member 30 in such a direction as to oppose the biasing force of the compression spring 29, with the result that the first stage gear 21 is released from the second stage gear 24. The gears 21 and 24 are locked and remain in such a released state. Upon reverse rotation of the lever member 30, the locked state is released, and again the first stage gear 21 of the driving shaft 20 engages the second stage gear 24. In this way, there is constructed a deceleration gear system having a deceleration ratio N, wherein the driving force is conveyed from the driving shaft 20 to the paper feeding roller shaft 13. The deceleration gear system causes rotation of the plate 22, thereby providing engagement and linkage or disengagement from the gear 21 of the driving shaft 20.

A support shaft 31 for the final stage gear 26 is rotatably supported on one side portion of the plate 22, while a support shaft 32 is rotatably supported on the upper side portion close to the support shaft 31. Rotatably supported on the support shaft 31 is an idler gear 33 meshing with a gear, i.e., the final stage gear 26 attached to the paper feeding roller shaft 13. Fitted to the support shaft 32 is a gear 34 having a larger diameter than that of the idler gear 33. The gear 34 engages with the idler gear 33. The gear 34 has a deceleration ratio of 1/1.5 or less to the gear 26 of the paper feeding roller shaft 13. The support shaft 32 projects outside the casing 10. The outer protrudent end of the support shaft 32 is provided with a knob 35. When the knob 35 is rotated by manual operation from outside of the casing 10, this rotational force is propagated via the gear 34, the idler gear 33 and the final stage gear 26 to the paper feeding roller shaft 13.

Figure 3:
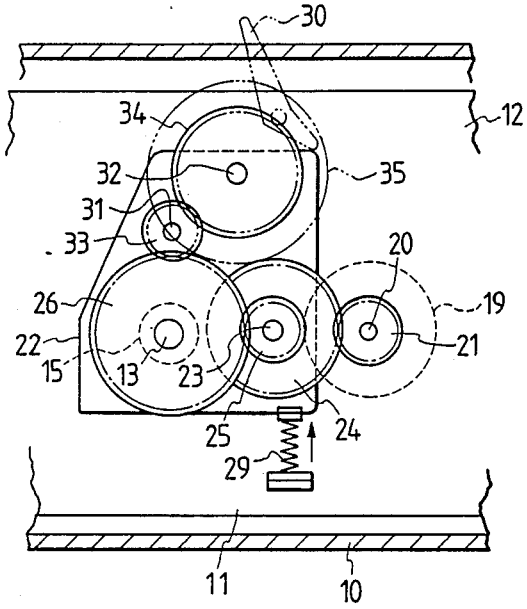
FIGS. 3 is a side view showing the paper feeding operation in the paper feeder according to the present invention.

FIG. 3 illustrates the rotational operation of the paper feeding roller 15 driven by the stepper motor 19 and the associated paper feeding operation. In a state depicted in FIG. 3, the plate 22 is rotationally held in such a position that the first stage gear 21 of the driving shaft 20 meshes with the second stage gear 24 supported on the plate by the biasing force of the compression spring 29. The paper feeding operation is followed by the step of driving the stepping motor 19. This driving force is transmitted via the deceleration gear system consisting of the gears 21, 24, 25 and 26 to the paper feeding roller shaft 13. As the paper feeding roller shaft 13 is rotated, the rollers 14 are also rotated. The paper sandwiched in between the paper feeding roller 15 and the friction roller 16 is fed out in the paper feeding direction by frictional feeding action in cooperation with the rotation of the paper feeding roller 15. Sheets of paper which have sequentially been fed are further transferred from the paper insertion port to the paper discharge port, passing by the front surface of the platen while being guided by a paper guide. These intermittent paper feeding operations are based on the driving of the stepper motor 19.

Figure 4:
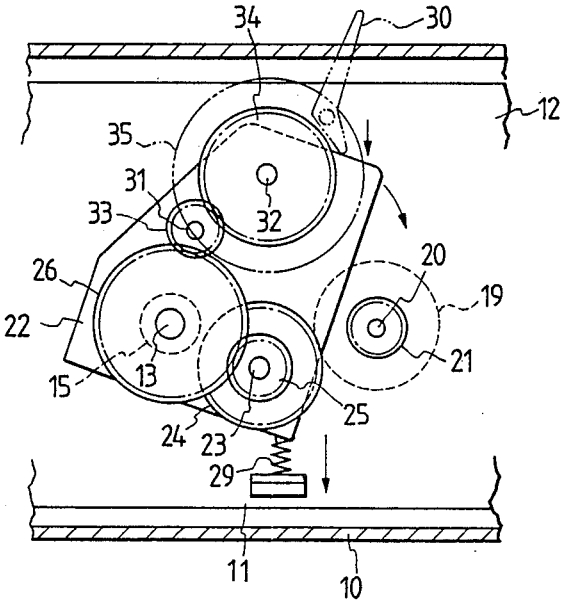
FIG. 4 is a side view showing the paper feeding operation in the paper feeder according to the present invent.
Figure 5:
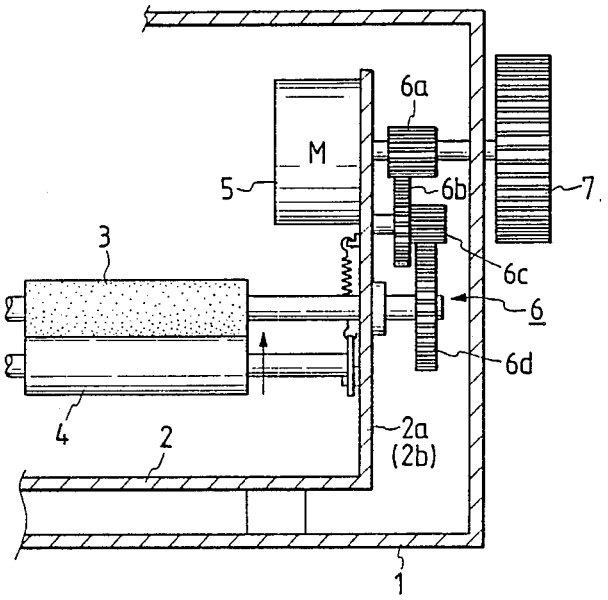
FIG. 5 (PRIOR ART)
FIG. 5 is a front elevational view depicting a conventional paper feeder and FIG. 6 is a front elevational view depicting a conventional paper fader.
Figure 6:
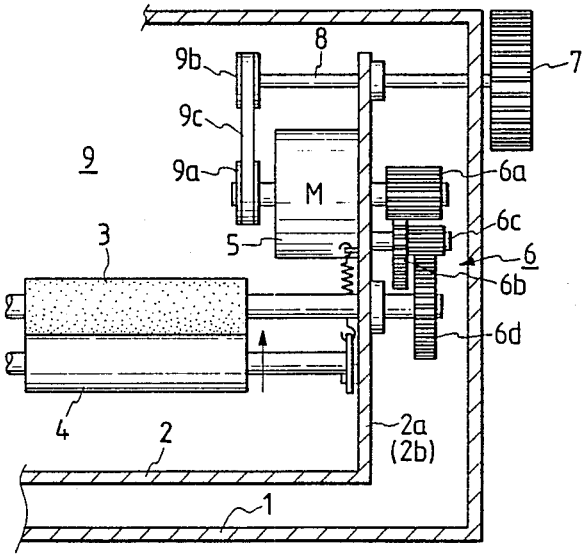
FIG. 6 (PRIOR ART)

Referring now to FIG. 4, there are illustrated the rotational operation of the paper feeding roller 15 which involves the manual operation of the knob 35 and also the associated manual paper feeding. In FIG. 4, the plate 22 is pushed down by the unidirectional operation of the lever member 30 in such a direction as to resist the compression spring 29, and is rotated about the paper feeding roller shaft 13 in the push-down direction. As a result of the rotation of the plate 22, the first stage gear 21 of the driving shaft 20 is released from the second stage gear 24 mounted on the plate 22. Subsequently, the plate 22 is locked in the rotated position so that the gears 21 and 24 are disengaged from each other. In this state, when making a positional adjustment of the paper to a printing start initial position, the knob 35 is rotated by manual operation. This rotational force is propagated through the gears 34, 33 and 26 to the paper feeding roller shaft 13, thereby rotating the paper feeding roller 15. Because of rotation of the paper feeding roller 15, the paper sandwiched in between the roller 15 and the friction roller 16 is fed with a predetermined amount of paper in the rotating direction of the paper feeding roller 15, thereby performing the positional adjustment to the initial printing position.

In this manner, the paper feeding process based on driving the stepper motor 19 is carried out with the aid of the deceleration gear system having a large deceleration ratio. The second stage gear 24 of the deceleration gear system supported on the plate 22 is released from the first stage gear 21 of the driving shaft 20. Subsequent to this step, the paper is manually fed by the manual operation of the knob 35 at a decreased deceleration ratio in connection with the knob 35 and the paper feeding roller shaft 13.

When the paper is fed out by driving the motor, the first stage gear 21 on the side of the motor and the second stage gear 24 are joined while being pushed against each other by the spring biasing force, and hence the backlash caused by the gear engagement at that time can be prevented. Since the backlash of the gear train can be minimized, a deviation in rotational phase of the paper feeding roller 15 that is due to the backlash can be diminished, thereby feeding paper with higher accuracy and reliability.

When manual paper feeding is performed, the deceleration ratio of the gear 26 to the gear 35, through which the knob 35 is connected to the paper feeding roller shaft 13, may be small, e.g., approximately 1/1.5. When the knob 35 is rotated, the arrangement is such that the paper is fed so that the deceleration gear system is separated from the motor. Therefore, a large amount of paper corresponding to the frequency of rotation of the knob 35 can be fed by manually rotating the knob 35. Furthermore, when effecting manual feeding, the knob 35 is separated from the driving shaft 20 of the motor 19, and it follows that the driving shaft of the motor is not concurrently rotated at all even when rotating the knob. Consequently, the motor is subjected to no load, and the knob can be turned by a still smaller force. It is therefore possible to smoothly perform paper feeding. Even in the case of adopting such a deceleration gear system having a remarkably large deceleration ratio as a worm gear mechanism incapable of making a reverse rotation, the manual paper feeding mechanism can readily be constructed.

In the prior art construction in which the driving shaft of the conventional motor is rotated, the driving shaft of the motor is lengthened, and the driving shaft protrudes on both sides of the motor body. The motor is thus arranged in conformity with a particular specification. According to the present invention, however, the driving motor can be constructed by employing commercially available inexpensive ready-made products that can be mass-produced. Hence, the cost can be reduced correspondingly, and an inexpensive paper feeder can thereby be attained. This results in a decrease in cost of manufacturing the printer.

The paper feeder described in the embodiment of the present invention can be applied to any type of printer whether it be a line printer or a serial printer. The paper feeder according to the present invention may broadly be employed for feeding the paper in a variety of printers designed for personal computers, word processors and so on.

As the gear of the driving shaft and the gear of the paper feeding roller shaft are arbitrarily meshed with or released from each other in accordance with the motor feeding or manual feeding by rotating the plate in one direction or in the other direction and because in the released state, the paper is manually fed by turning the knob, paper can be fed manually without imparting the load caused by the motor to rotation of the knob. It is therefore possible to smoothly rotate the paper feeding roller shaft by turning the knob by a smaller force. Faster rotation than in the prior art can be attained at a deceleration ratio of 1/1 or at an approximate ratio when directly rotating the paper feeding roller shaft by making one rotation of the knob, whereby a large amount of manual paper feed can be obtained with faster motion and increased smoothness. In contrast with the prior art, a simplified construction which requires a small number of components can be actualized. There is no necessity for using an expensive motor having a particular specification, rather a commercially available inexpensive motor may be used. This leads to a decrease in the cost of manufacturing the paper feeder.

While the invention has been described in connection with what is presently considered to be the most practical and preferred embodiments, it is to be understood that the invention is not limited to the disclosed embodiment but, on the contrary is intended to cover various modifications included within the spirit and scope of the appended claims.

What is claimed is:

1. A paper feeder comprising:

a frame;

a motor mounted on said frame for generating a driving force;

a deceleration gear train mounted on said frame;

means mounted on said frame for transferring said driving force from said motor to said deceleration gear train;

a paper feeding roller;

a paper feeding roller shaft mounting said roller for transferring said driving force from said deceleration gear train to said paper feeding roller;

a plate supported on said paper feeding roller shaft so as to be freely rotatable about an axis thereof, the rotation of said plate in a first direction permitting engagement of said paper feeder roller with said deceleration gear train and rotation of said plate in a second direction permitting disengagement of said paper feeder roller and said deceleration gear train;

means for manually rotating said paper feeding roller shaft when said paper feeding roller is disengaged from said deceleration gear train.

2. A paper feeder as claimed in claim 1 wherein said plate is supported on said paper feeding roller shaft so as to be rotatable about an axial center thereof.

3. A paper feeder as in claim 2 further comprising a return spring for rotational biasing said plate in such a direction so that said deceleration gear train means engages said paper feeding roller.

4. A paper feeder as in claim 3 further comprising a lever attached to said plate, the rotation of said lever causing the rotation of said plate.

5. A paper feeder as in claim 4 wherein said rotating means further includes a knob disposed to be connected to said motor or said paper feeding roller to drive said motor or rotate said paper feeder roller.

* * * * *